United States Patent [19]

Kobayashi

[11] 4,296,694

[45] Oct. 27, 1981

[54] GUITARIST'S FOOT-REST

[76] Inventor: Itaru Kobayashi, 1-15-2, Motomachi, Kiyose City, Tokyo, Japan

[21] Appl. No.: 105,569

[22] Filed: Dec. 20, 1979

[30] Foreign Application Priority Data

Dec. 26, 1978 [JP] Japan ..... 53/159122

[51] Int. Cl.[3] ..... A47C 9/12

[52] U.S. Cl. ..... 108/116; 297/439; 248/421

[58] Field of Search ..... 108/116, 117, 119; 248/421, 422, 423; 297/439, 361

[56] References Cited

U.S. PATENT DOCUMENTS

| | | | |
|---|---|---|---|
| 130,494 | 8/1872 | Gilbert | 108/116 |
| 213,512 | 3/1879 | Landis | 108/116 |
| 876,857 | 1/1908 | Bugbee | 108/117 |
| 2,843,391 | 7/1958 | Pelletier | 108/116 |
| 3,044,830 | 7/1962 | Kolle | 297/361 |
| 3,724,895 | 4/1973 | Brand | 248/422 |

*Primary Examiner*—Francis K. Zugel

*Attorney, Agent, or Firm*—Gifford, VanOphem, Sheridan & Sprinkle

[57] ABSTRACT

The invented guitarist's foot-rest comprises a tread-board, a pair of crossed legs to support said tread-board and a pair of parallel height regulating plates attached below said tread-board. Each of said height regulating plates is provided with recesses for receiving the rod connecting the upper ends of the free legs and recesses for receiving single or double wire staples attached adjacent to one or both ends of the connecting rod. A guitarist can adjust the height of the foot-rest merely by turning the connecting rod with one hand while sitting in a chair and holding. Further, it is preferable to provide a spring below the tread-board between the height regulating plates. One end of said spring is attached to one end of the tread-board while the other portion extending along said tread-board to prevent the disengagement of the connecting rod from the corresponding recess.

2 Claims, 7 Drawing Figures

GUITARIST'S FOOT-REST

BACKGROUND OF THE INVENTION

Before playing a guitar, guitarist sits on a chair holding a guitar and putting his foot on a foot-rest.

A foot-rest plays an important role, because putting guitarist's foot on it not only stabilizes the guitar but also brings the guitar to the most convenient position to play.

The hitherto known foot-rest comprises a tread-board, a pair of crossed legs supporting said tread-board and a pair of height regulating plates, attached below the tread-board. Each of the regulating plates is provided with a number of recesses to be engaged with the rod connecting the upper ends of the free legs so as to regulate the height of the foot-rest.

To adjust the height of such a foot-rest, the guitarist leaves the chair while putting his guitar aside on the floor and with both hands, the connecting rod is moved so as to engage with other recesses. But, as the tread-board as well as the floor gather dust and dirt, guitarist's hand and his guitar will be soiled. After adjustment, the player again sits on a chair to test again the height of the foot-rest. If he finds the height of the foot-rest still unsatisfactory, he must again stand up and adjust the foot-rest anew.

SUMMARY OF THE INVENTION

The present invention has for its object to do away with such defects of the hitherto known foot-rest.

According to this invention, the height of the foot-rest can be adjusted with one hand while sitting on a chair holding a guitar.

The invented foot-rest employs novel height regulating plate. Each plate is provided with not only recesses for receiving the connecting rod but also other recesses for receiving wire staple attached to the connecting rod.

BRIEF DESCRIPTION OF THE DRAWINGS

Examples of the invented foot-rest are illustrated in the following drawing in which.

DESCRIPTION OF THE PREFERRED EMBODIMENT

Figure 1:
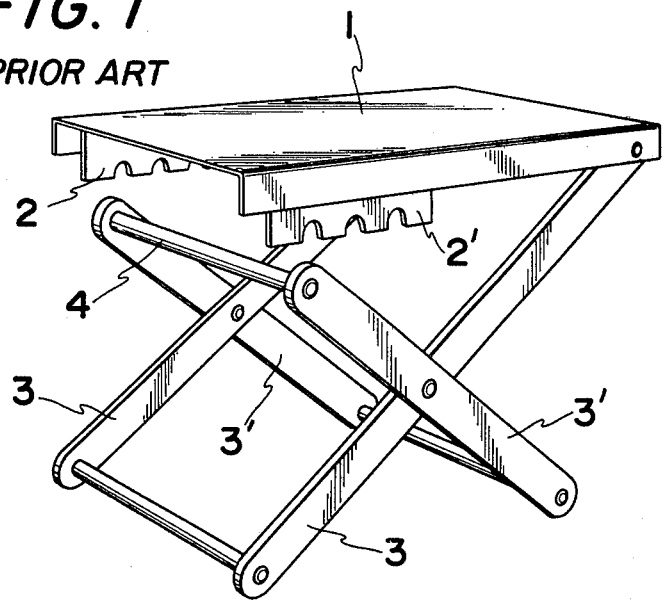
FIG. 1 PRIOR ART
FIG. 1 is a perspective view of a hitherto known foot-rest.

As shown in FIG. 1, a well known guitarist's foot-rest comprises a tread-board 1, a pair of crossed legs 3 and 3' for supporting said tread-board 1, and a pair of height regulating plates 2 and 2', each of them being provided with a number of recesses to receive the connecting rod 4 therein.

The plates 2 and 2 are parallel and attached below the tread-board 1. Each of the plates is provided with three recesses, so the height of the foot-rest can be adjusted in three ways.

As discussed previously, the guitarist sits on a chair holding a guitar and puts one foot on the foot-rest to test whether the height of the foot-rest is proper or not. If the foot-rest be too high or too low, the guitarist stands up and transfers the connecting rod into another recess with both hands while putting his guitar aside on the floor. As the foot plate 1 and the floor gather dust and dirt, his hands as well as the guitar will be soiled.

After adjustment, the guitarist again sits on a chair to ascertain whether the new height of the foot-rest is proper or not. If the new height be still unsatisfactory, guitarist repeats the adjustment. It is very harassing.

This invention provides a height regulating mechanism as described below.

Figure 2:
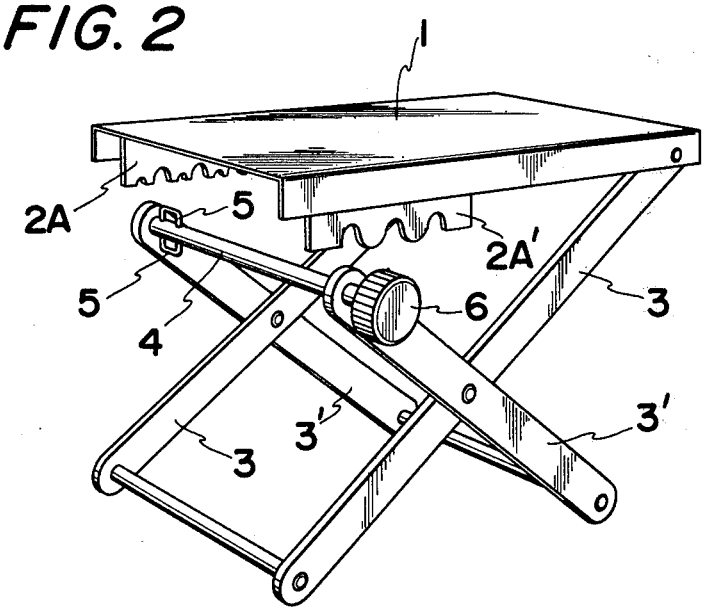
FIG. 2 is a perspective view of the invented foot-rest.
Figure 6:
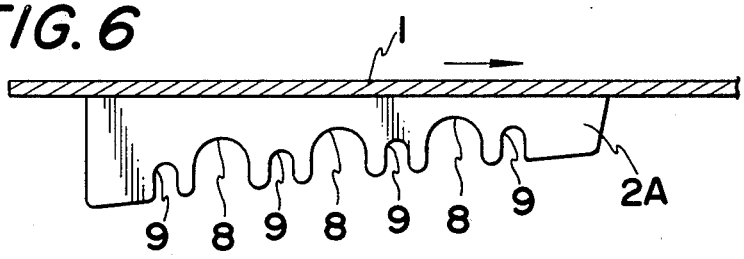
FIG. 6 is a front view of the novel height regulating plate.

As shown in FIG. 2, the connecting rod 4 is provided with a pair of wire staples 5 adjacent to one end. And, a pair of novel height regulating plates 2A and 2A' are attached below the tread-board 1. The height regulating plates 2A is provided with large recesses 8 for the connecting rod 4 and small recesses 9 for the wire staples 5 as shown in FIG. 6.

Figure 4:
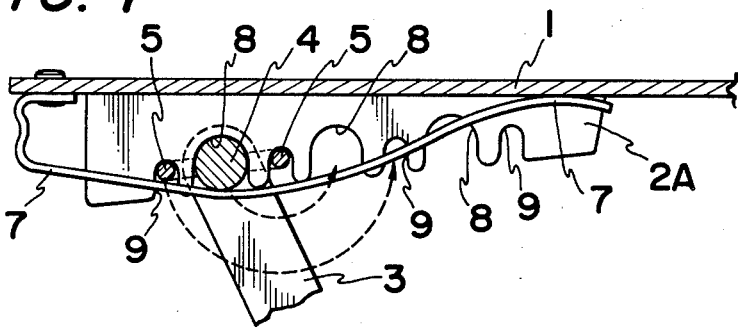
FIG. 4 shows the mode of transfering the connecting rod to a new position, wherein said connecting rod is provided with double staples.

In FIG. 4, the connecting rod 4 is shown inserted in the first recesses 8 and the wire staples 5 inserted in small recesses 9 arranged beside the large recess. It is the lowest position.

To increase the height, the connecting rod 4 is turned 180° counter-clockwise through a knob 6 attached to one end of said connecting rod. Then, the connecting rod 4 is transferred into the second recess 8 around one of the staples 5 and another staple is transferred into a new recess 9 situated on the right side of the recess 8 as shown by dotted lines. By turning the connecting rod 4 further 180° counter-clockwise, the connecting rod 4 will be engaged with the third recess 8 and so on. In this manner, the height of the foot-rest can be increased step by step. During these adjustments, the guitar player need not leave from the chair and by turning the connecting rod 4 through the knob 6, the adjustment can be performed easily with single hand while sitting on the chair holding a guitar.

Figure 3A:
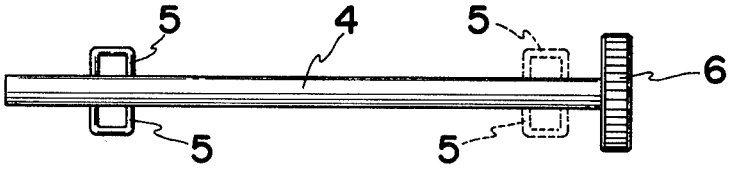
FIG. 3A shows the connecting rod.

Instead of a pair of wire staples 5, two such pairs of wire staples may be attached adjacent to both ends of the connecting rod 4 as shown in dotted lines in FIG. 3A.

Figure 3B:
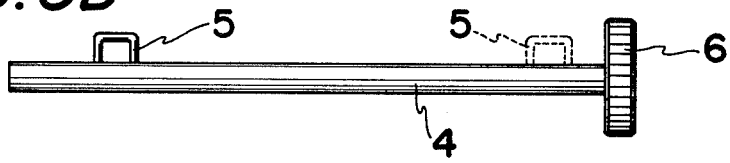
FIG. 3B shows a modified connecting rod.

Further, the connecting rod 4 may be provided with one single wire staple 5 adjacent to one end of said connecting rod, or two at both ends as shown in FIG. 3B.

Figure 5:
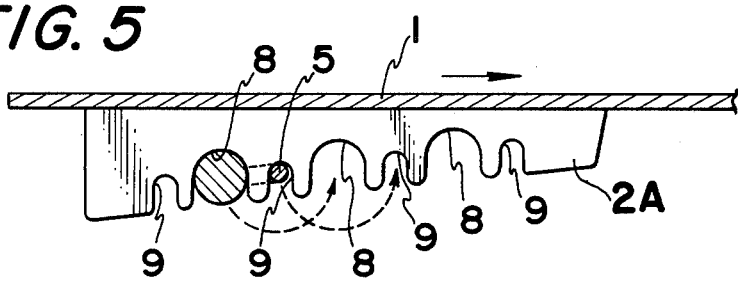
FIG. 5 shows the mode of transfering connecting rod to a new position, wherein said connecting rod is provided with single staple.

In FIG. 5, the connecting rod 4 is inserted in the first recess 8 while the single wire staple 5 is inserted in the recess 9 on the right side of said recess 8. by turning the connecting rod 4 180° counter-clockwise, the connecting rod 4 will be transferred to the second recess 8 around the wire staple 5. By further turning of the connecting rod 4 180° counter-clockwise, only the wire staple 5 is transferred to another recess 9 around the connecting rod 4 as shown by dotted lines. By repeating the turning of the connecting rod 4, the connecting rod will successively be moved to the right whereby the height of the foot-rest is increased step by step. It is obvious that the height of the foot-rest can be reduced by turning the connecting rod 4 clockwise.

It is preferable to provide a spring 7 between the height regulating plates 2A and 2A'. One end of said spring is attached to one end of the tread-board 1 and the other portion extends below the tread-board so as to press the connecting rod 4 upward whereby the disengagement of the connecting rod 4 from the corresponding recess may be prevented.

What I claim is:

1. Guitarist's foot-rest comprising;

a tread-board, a pair of cross legs for supporting said tread-board, a rod connecting the upper ends of the free legs having single wire staple or double wire staples, and a pair of parallel height regulating plates attached below the tread-board, each of said height regulating plates being provided with a number of recesses for receiving the connecting rod and recesses for receiving single or double wire staples.

2. Guitarist's foot-rest as defined by claim 1 wherein a spring is attached to one end of the tread-board and the other portion of said spring extends longitudinally below the tread-board to prevent the connecting rod from disengaging from the corresponding recess.

* * * * *